US006978847B2

(12) United States Patent
Buchholz

(10) Patent No.: US 6,978,847 B2
(45) Date of Patent: Dec. 27, 2005

(54) HAMMER

(75) Inventor: Achim Buchholz, Limburg (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/691,221

(22) Filed: Oct. 22, 2003

(65) Prior Publication Data

US 2004/0112614 A1 Jun. 17, 2004

(30) Foreign Application Priority Data

Oct. 23, 2002 (GB) ..... 0224652

(51) Int. Cl.[7] ..... E02D 7/02
(52) U.S. Cl. ..... 173/109; 173/201
(58) Field of Search ..... 173/48, 104, 109, 173/171, 201; 403/52, 67, 150, 161–163, 403/292, 294, 122, 127, 152, 154, 57

(56) References Cited

U.S. PATENT DOCUMENTS

| | | | | |
|---|---|---|---|---|
| 1,812,934 A | * | 7/1931 | Curtis | 464/134 |
| 1,939,959 A | * | 12/1933 | Burns | 403/154 |
| 2,422,327 A | * | 6/1947 | Winslow | 403/152 |
| 2,850,340 A | * | 9/1958 | Brill | 403/154 |
| 4,138,838 A | | 2/1979 | Long | |
| 4,291,614 A | * | 9/1981 | Molle et al. | 403/158 |
| 4,371,357 A | | 2/1983 | Petrzelka et al. | |
| 4,419,086 A | | 12/1983 | Condon | |
| 4,446,931 A | * | 5/1984 | Bleicher et al. | 173/48 |
| 4,537,264 A | * | 8/1985 | Schmid et al. | 173/48 |
| 4,955,741 A | | 9/1990 | Komeyama | |
| 5,277,259 A | * | 1/1994 | Schmid et al. | 173/109 |
| 5,813,916 A | | 9/1998 | Lentini et al. | |
| 5,865,678 A | | 2/1999 | Keodam et al. | |
| 6,238,318 B1 | | 5/2001 | Itoh et al. | |
| 6,336,868 B1 | | 1/2002 | Kurecka et al. | |

FOREIGN PATENT DOCUMENTS

| | | |
|---|---|---|
| EP | 0445107 A | 3/1991 |
| GB | 2085345 A | 9/1981 |

* cited by examiner

*Primary Examiner*—Scott A. Smith
(74) *Attorney, Agent, or Firm*—Michael P. Leary; Charles E. Yocum; Adan Ayala

(57) ABSTRACT

An electrically powered hammer comprises a housing, a spindle, a piston reciprocatingly mounted within the spindle, a wobble drive arrangement reciprocatingly connected to the piston, and a trunnion arrangement including a cross bolt is driving engaged between the wobble drive arrangement and the piston. The piston includes a pair of piston arms and a protrusion so that the first piston arm and the protrusion define a first recess and the second piston arm and the protrusion define a second recess, and each of the recesses is shaped so as to support a wear reducing washer in an assembled position. When assembled, each washer fits around the cross bolt in a region adjacent the inwardly facing face of the associated piston arm so as to reduce wear between the cross bolt and the piston arms.

10 Claims, 2 Drawing Sheets

HAMMER

This invention relates to electrically powered hammers, in particular hammers having an air cushion hammering mechanism including a wobble drive arrangement.

BACKGROUND OF THE INVENTION

Such hammers will normally have a housing and a hollow cylindrical spindle mounted in the housing. The spindle allows insertion of the shank of a tool or bit, for example a drill bit or a chisel bit, into the front end thereof so that it is retained in the front end of the spindle with a degree of axial movement. The spindle may be a single part or may be made of two or more parts, which together form the hammer spindle. For example, a front part of the spindle may be formed as a separate tool holder body for retaining the tool or bit. Such hammers are provided with an impact mechanism which converts the rotational drive from an electric motor to a reciprocating drive causing a piston, which may be a solid piston or a hollow piston, to reciprocate within the spindle. The piston reciprocatingly drives a ram by means of a closed air cushion located between the piston and the ram. The impacts from the ram are transmitted to the tool or bit of the hammer, optionally via a beatpiece.

Some hammers can also be employed in combination impact and drilling mode or in a drilling only mode in which the spindle, or a forwardmost part of the spindle, and hence the bit inserted therein will be caused to rotate. In the combination impact and drilling mode the bit will be caused to rotate at the same time as the bit receives repeated impacts. A rotary drive mechanism transmits rotary drive from the electric motor to the spindle to cause the spindle, or a forwardmost part thereof to rotate.

In smaller hammers, a wobble drive arrangement is generally used to convert a rotary drive from the motor to the reciprocating drive of the piston. In a known arrangement the rotary drive from the motor is transmitted to an intermediate shaft mounted within the hammer housing generally parallel to the axis of the spindle. A wobble sleeve is rotatably mounted on the intermediate shaft. The wobble sleeve is formed with a wobble race which extends around the wobble sleeve at an oblique angle to the axis of the intermediate shaft. Balls are set to run between this inner race and an outer race of a wobble ring, which wobble ring has a wobble pin extending from it to the rearward end of the piston.

The wobble pin reciprocatingly drives the piston via a trunnion arrangement, which generally includes a pair of spaced arms extending rearwardly of the main body of the piston and a cross bolt. Each arm is formed with a through hole and the cross bolt is received through said through holes. A central portion of the cross bolt, lying between the two arms is formed with a through hole, through which the end of the wobble pin remote from the wobble ring extends. During hammering the wobble pin is reciprocatingly driven forwardly and rearwardly, with respect to the longitudinal axis of the spindle by the wobble drive arrangement. The wobble pin reciprocatingly drives the piston via the cross bolt and the piston arms. As the wobble pin reciprocates its orientation changes which causes the cross bolt to rotate, about the longitudinal axis of the cross bolt, with respect to the through holes of the piston arms. Also, to a limited extent the cross bolt is caused to reciprocate laterally along the direction of the longitudinal axis of the cross bolt with respect to the through holes of the piston arms. Accordingly, there is a significant amount of wear between the cross bolt and the piston arms.

One way of reducing this wear is by locating a U-shaped washer arrangement made from a bent strip of spring steel in the space between the piston arms. The U-shaped washer has a base from which the two arms extend to form the U-shape so that plane faces of the strip abut the base and the inwardly directed faces of the piston arms. Each arm of the washer is formed with a through hole, so that when the washer is fitted in the space between the piston arms, with the base of the washer abutting the rearward surface of the piston main body, the through holes in the washer arms align with the through holes in the piston arms. Then the cross bolt is fitted through the through holes in the washer arrangement as well as the through holes in the piston arms. The U-shaped washer has the advantage that it is easy to assemble onto the piston, however, it has the disadvantage that it is not free to rotate with the cross bolt, which is not ideal for the reduction of wear.

BRIEF DESCRIPTION OF THE INVENTION

The present invention aims to provide an electrically powered hammer with a trunnion arrangement having reduced wear.

According to the present invention there is provided a powered hammer comprising:

a hammer housing within which a hollow spindle is located;

a hammering mechanism for generating repeated impacts on a tool or bit of the hammer, which hammering mechanism includes a piston reciprocatingly mounted within the spindle;

a wobble drive arrangement for reciprocatingly driving the piston; and a trunnion arrangement including a cross bolt engaged by the wobble drive arrangement which cross bolt is rotatably mounted between a pair of piston arms which arms extend rearwardly of the piston;

characterised in that a protrusion is located on the rearward end of the piston between the piston arms which protrusion defines two recesses one between the protrusion and the first arm and the other between the protrusion and the second arm, each of which recesses is shaped so as to support an associated washer of a pair of wear reducing washers in an assembled position.

By providing the recesses at the rearward end of the piston, during assembly two separate washers can be supported on the rearward end of the piston in an assembled position. The cross bolt can then be passed through the washers and mounted between the piston arms, to secure the washers with respect to the rearward end of the piston. This facilitates the assembly of two separate washers, of a conventional type, instead of a specially adapted washer arrangement, such as the U-shaped washer arrangement of the type described above, and so provides a cost reduction in the components of the hammer. In addition the washers are free to rotate with the cross bolt which provides a reduction in wear. The protrusion on the rearward end of the piston also provides extra structural strength to the piston. When assembled onto the piston with the cross bolt mounted between the piston arms, each washer fits around the cross bolt in a region adjacent the inwardly facing face of the associated piston arm so as to reduce wear between the cross bolt and the piston arms.

In one embodiment the protrusion is formed on its rearward end with an arcuate bearing surface against which the cross bolt bears. This provides a further bearing surface for the cross bolt, in addition to the bearing surfaces provided at the interface between the cross bolt and the first piston arm and the cross bolt and the second piston arm, which also contributes to a reduction in wear between the piston arms and the cross bolt.

The base of each recess may be formed as an arcuate bearing surface for the periphery of the associated washer so as to support and guide any rotation of the washer with the cross bolt.

The cross bolt may be mounted through a pair of through holes one of which is formed in each piston arm. Alternatively, a through hole could be formed in one of the arms and a facing recess formed in the other of the arms, in which case the cross bolt could be assembled between the piston arms by passing it through the through hole until it engages in the recess in the opposing piston arm. In the assembled position the washers will generally each have radially inner edges aligned with the associated through hole.

The wobble drive arrangement will generally comprises a rotatably driven wobble sleeve with a wobble ring mounted on the wobble sleeve via a bearing positioned at an angle oblique to the longitudinal axis of the sleeve and a wobble pin extends radially outwardly of the wobble ring for engaging the cross bolt. Then as the wobble sleeve is rotatingly driven, for example by a shaft rotatingly driven by an electric motor of the hammer, the wobble pin is caused to reciprocate in a direction more or less in line with the longitudinal axis of the spindle. The bolt may be formed with a through hole in a region central of the piston arms for receiving a wobble pin of the wobble drive arrangement.

The piston may be a hollow piston, of the type commonly used within the art, within which a ram is reciprocatingly mounted in such a way that during hammering the reciprocating drive from the piston is transferred to the ram by a closed air cushion formed within the hollow piston. Alternatively, the piston may be a solid piston, of the type well known within the art, and a ram is reciprocatingly mounted within the spindle forwardly of the piston in such a way that during hammering the reciprocating drive from the piston is transferred to the ram by a closed air cushion formed within the spindle.

The piston is generally made of a strong light material, such as aluminium, the cross bolt is generally made of steel, but may also be made of a plastic part, and the washers may be made of steel.

According to the present invention there is also provided a piston for a hammering mechanism of an electrically powered hammer comprising:

a cylindrically shaped main body which can be slideably mounted within a spindle of a hammer;

a pair of piston arms extending rearwardly from the rearward end of the main body between which can be mounted a cross bolt of a trunnion arrangement;

characterised in that the piston additionally comprises a protrusion located on the rearward end of the main body between the piston arms which protrusion defines two recesses one between the protrusion and the first arm and the other between the protrusion and the second arm, each of which recesses is shaped so as to support an associated washer of a pair of wear reducing washers in an assembled position.

The piston may have the features discussed above in relation to the piston of the electrically powered hammer according to the present invention.

The present invention also provides a method of assembling a piston and trunnion arrangement sub-assembly of an electrically powered hammer in which the sub-assembly comprises the piston described above, the method comprising the steps of:

supporting a washer in each of the recesses in the assembled position; and mounting the cross bolt between the piston arms by passing the cross bolt through the washers.

BRIEF DESCRIPTION OF THE DRAWINGS

An embodiment of a hammer according to the present invention will now be described by way of example, with reference to the accompanying drawings in which.

DETAILED DESCRIPTION OF THE INVENTION

Figure 1:
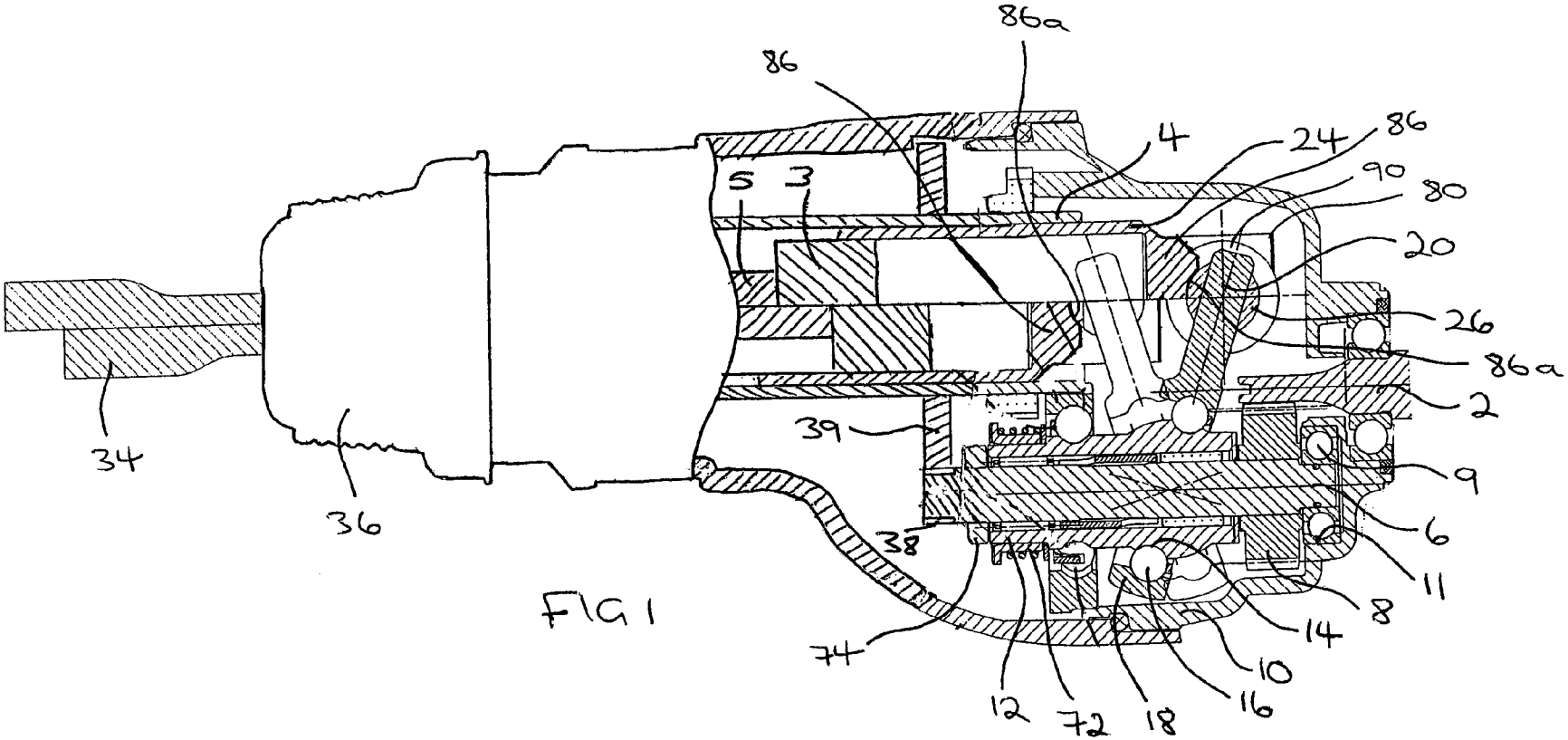
FIG. 1 is a partially cut away side cross-sectional elevation of the forward part of a rotary hammer according to the present invention.

The rotary hammer has a forward portion which is shown in FIG. 1 and a rearward portion incorporating a motor and a rear handle, in the conventional way. The handle may be of the pistol grip or D-handle type. The handle portion incorporates a trigger switch for actuating the electric motor, which motor is formed at the forward end of its armature shaft with a pinion (2). The pinion (2) of the motor rotatingly drives an intermediate shaft (6) via a gear (8) which gear is press fit onto the rearward end of the intermediate shaft (6). The intermediate shaft is mounted within a metal rearward housing part (10) of the hammer, so that it can rotate about it longitudinal axis. The intermediate shaft is mounted in the housing part (10) via a rearward bearing (9) which is press fitted onto the rearward end of the intermediate shaft and is fitted into a receiving recess (11) of the housing part (10). In the FIG. 1 arrangement the longitudinal axis of the motor is parallel with the longitudinal axis of the hollow cylindrical spindle (4) of the hammer. Alternatively, the motor could be aligned with its axis perpendicular to the axis of the spindle (4), in which case a bevel pinion would be formed at the end of the armature shaft of the motor, to mesh with a bevel gear press fit on the intermediate shaft (6) replacing the gear (8).

A wobble sleeve (12) is mounted on the intermediate shaft (6) using needle bearings, so that it can rotate with respect to the intermediate shaft. The wobble sleeve (12) carries the inner race (14) for the ball bearings (16) of a wobble ring (18) from which extends a wobble pin (20). The balls are mounted between the inner race (14) and an outer race formed in the wobble ring (18). Thus, as the wobble sleeve (12) rotates the end of the wobble pin (20) remote from the wobble ring (18) is caused to reciprocate, in order to reciprocatingly drive a hollow cylindrical piston (24). The most rearward position of the wobble pin (20) is shown cross-hatched in FIG. 1 and the most forward position of the wobble pin (20) is shown unshaded in FIG. 1. The end of the wobble pin reciprocatingly drives the piston (24) via a trunnion arrangement including a cross bolt (26).

Figure 3:
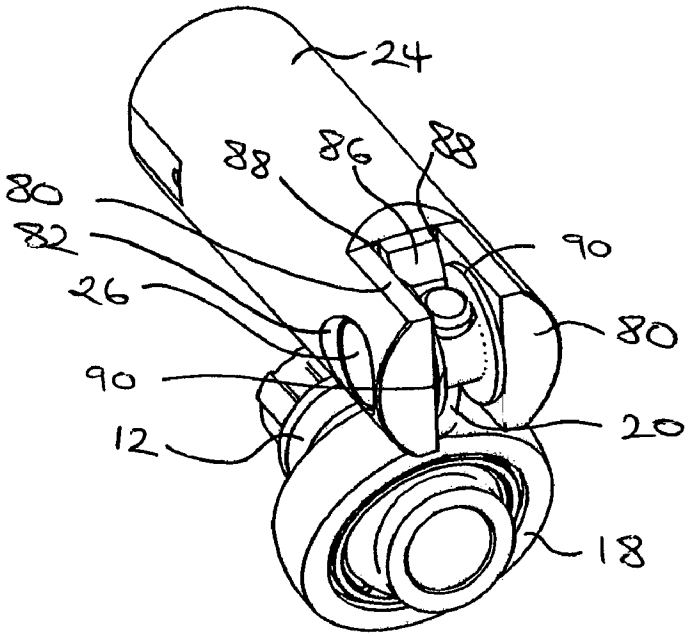
FIG. 3 is a perspective view of the sub-assembly of FIG. 2 in an assembled state.
Figure 2:
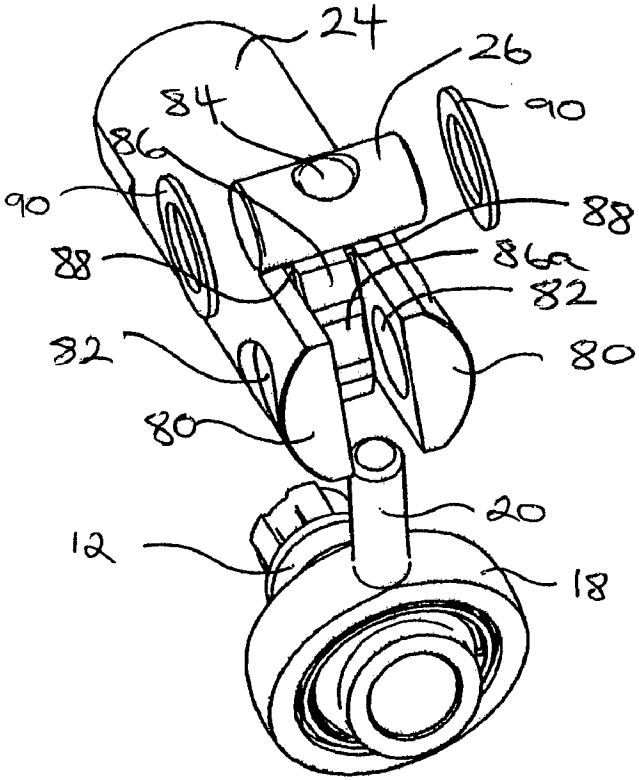
FIG. 2 is a disassembled perspective view of a sub-assembly of the hammer of FIG. 1 including a trunnion arrangement, a piston and a wobble drive arrangement.

As is best seen in FIGS. 2 and 3, the hollow piston (24) has two arms (80) which extend rearwardly from the rearward end of the piston, so as to leave a space between the arms. Each arm (80) is formed with a through hole (82) which extends through the arm in a direction transverse to the longitudinal axis of the spindle (4). The cross bolt (26) is received through the through holes (82). The cross bolt (26) is itself formed with a through hole (84), which through hole is located at the centre of the cross bolt and extends through the cross bolt in a direction transverse to the longitudinal axis of the cross bolt. The end of the wobble pin (20) remote from the wobble ring (18) is received through the through hole (84) of the cross bolt (26).

During hammering, the wobble pin (20) is reciprocatingly driven forwardly and rearwardly by the wobble drive arrangement. The wobble pin (20) reciprocatingly drives the piston (24) via the cross bolt (26) and the piston arms (80). As the wobble pin reciprocates, the changing orientation of the wobble pin (20) causes the cross bolt (26) to rotate about its longitudinal axis with respect to the through holes (82). The changing orientation of the wobble pin (20) also cases the cross bolt (26) to move laterally in the direction of the longitudinal axis of the cross bolt, with respect to the through holes (82).

The rearward end of the piston is formed with a protrusion (86) between the arms (80) arranged so as to leave a recess (88) between the protrusion and each piston arm (80). A circular washer (90) is received by each recess (88) and the recesses (88) are formed with an arc shaped base adapted to the shape of the circular washer (90). The recesses (88) are narrow and support the washers (90) in their assembled position with the holes in the washers (90) aligned with the through holes (82) of the piston arms (80), prior to assembly of the cross bolt (26). Therefore, the washers are easy to assemble onto the rearward end of the piston. The cross bolt (26) is assembled through the washers (90) and through the through holes (82) in the piston arms (80) and this secures the washers with respect to the rearward end of the piston. The washers (90) have the advantage that they can rotate with the cross bolt (26) which helps in the reduction of wear between the cross bolt and the piston. In addition the washers (90) are much cheaper than the special U-shaped washer arrangement previously used. The protrusion (86) also acts to strengthen the rearward end of the piston (24). The rearward portion of the protrusion is formed with an arc shaped recess (86*a*) which receives a portion of the side surface of the cross bolt (26). Therefore, the arc shaped recess (86*a*) acts as an additional bearing surface for the rotating cross bolt (26) and so will also help to reduce wear around the through holes (82) in the piston arms (80)

The hollow cylindrical piston (24) is slideably located within the hollow cylindrical spindle (4). A ram (3) is slideably mounted within the hollow cylindrical piston and an 0-ring seal is mounted around the ram so as to seal between the periphery of the ram and the internal surface of the piston. During normal operation of the hammer, a closed air cushion is formed between the interior of the piston and the rearward face of the ram and so the ram is reciprocatingly driven by the piston via the closed air cushion. During normal operation of the hammer the ram repeatedly impacts a beapiece (5), which beatpiece is mounted within the spindle so as to be able to undergo limited reciprocation. The beatpiece (5) transfers impacts from the ram to a tool or bit (34) mounted within a forward tool holder portion of the spindle by a tool holder arrangement (36), for example an SDS-type tool holder. The tool or bit (34) is releasably locked within the tool holder portion of the spindle so as to be able to reciprocate within the tool holder portion of the spindle by a limited amount. In FIG. 1 the ram and beatpiece are shown in their idle mode position in the upper half of the spindle (4) and in their operating position in the lower half of the spindle.

The spindle (4) which may be rotatingly mounted within the hammer housing (10, 15) can be rotatingly driven by the intermediate shaft (6), as described below. Thus, as well as or instead of reciprocating, the tool or bit (34) can be rotatingly driven because it is non-rotatably mounted within the spindle (4) by the tool holder arrangement (36). Thus, the hammer may have three modes, a drilling only mode in which no hammering occurs and the spindle is rotatingly driven; a hammer drilling mode in which hammering occurs and the spindle is rotatingly driven and a chisel or hammer only mode in which hammering occurs but there is no rotary drive to the spindle and in which the spindle is generally locked against rotation.

The intermediate shaft (6) is formed at its forward end with a pinion (38) which is selectively engageable with a spindle drive gear (39). A mode change element in the form of a ring (72) is non-rotatably but axially slideably mounted on the forward portion of the wobble sleeve (12), co-axially with the intermediate shaft (6). The mode change ring is mounted on the wobble sleeve via driven teeth, which take the form of two opposing splines formed on the outer surface of the forward end of the wobble sleeve (12). The driven teeth or splines engage in a pair of cooperating recesses which are formed in the radially inward facing surface of the mode change ring. The recesses extend axially from the forward to the rearward facing face of the mode change ring. The recesses of the mode change ring (72) are selectively engageable with an opposing pair of a set of drive teeth (74) formed on an increased outer diameter portion of the intermediate shaft (6). When the mode change ring (72) is in a rearward position, as shown in FIG. 1, no rotary drive is transmitted from the intermediate shaft (6) to the wobble sleeve (12) and so no hammering occurs. When the mode change ring (72) moves forwardly, from the position shown in FIG. 1, the recesses in the mode change ring (72) engage an opposing pair of the set of drive teeth (74) formed on the intermediate shaft (6). In the forward position of the mode change ring (72) the recesses in the mode change ring straddle the intermediate shaft drive teeth (74) and the splines on the wobble sleeve (12). Thus, in the forward position of the mode change ring (72) rotary drive is transmitted from the intermediate shaft (6) to the wobble sleeve (12) via the mode change ring (72) and hammering occurs.

What is claimed is:

1. A powered hammer comprising:

a hammer housing;

a hollow spindle located in the housing;

a hammering mechanism including a piston reciprocatingly mounted within the spindle; the piston including at least one rearwardly extending piston arm and a rearward protrusion, the piston arm and the protrusion defining a recess between the piston arm and the protrusion;

a wobble drive arrangement drivingly connected to the piston;

a trunnion arrangement drivingly connected between the piston and the wobble drive arrangement, the trunnion arrangement including a cross bolt and at least one washer, the washer at least partly located within the recess, and the cross bolt rotatably connected to the piston arm; and wherein the recess is shaped so as to support the washer in an assembled position.

2. A hammer according to claim 1 wherein the washer fits around the cross bolt and adjacent to the piston.

3. A hammer according to claim 1 wherein the protrusion defines an arcuate bearing surface and the cross bolt is supportable by the arcuate bearing surface.

4. A hammer according to claim 1 wherein the piston includes an arcuate bearing surface, the arcuate bearing surface partly defines the recess, and a periphery of the washer is supportable by the arcuate bearing surface.

5. A hammer according to claim 1 wherein the piston arm defines a through hole and the cross bolt is mounted through the through hole.

6. A hammer according to claim 5 wherein the washers define a circular cutout and the washer cutout is aligned with the through hole.

7. A hammer according to claim 1 wherein the wobble drive arrangement includes a wobble pin, and the cross bolt defines a radial through hole, and the wobble pin protrudes into the through hole.

8. A hammer according to claim 1 wherein the wobble drive arrangement includes a rotatably driven wobble sleeve, a wobble ring mounted on the wobble sleeve via a bearing, and a wobble pin extending radially outwardly of the wobble ring for engaging the cross bolt.

9. A hammer according claim 1 wherein the hammering mechanism includes a ram, and the piston is a hollow piston, and the ram is reciprocatingly mounted within the hollow piston such that during hammering the reciprocating drive from the piston is transferred to the ram by a closed air cushion formed within the hollow piston.

10. A hammer according to claim 1 wherein the piston is made of aluminium, the cross bolt is made of steel and the washer is made of steel.

* * * * *